US006446014B1

(12) United States Patent
Ocondi

(10) Patent No.: US 6,446,014 B1
(45) **Date of Patent: *Sep. 3, 2002**

(54) METHOD AND APPARATUS FOR MEASURING AND CONTROLLING THE FLOW OF FLUIDS FROM COAL SEAM GAS WELLS

(76) Inventor: Cham Ocondi, 4369 S. Atchison Cir., Aurora, CO (US) 80015

( * ) Notice: Subject to any disclaimer, the term of this patent is extended or adjusted under 35 U.S.C. 154(b) by 0 days.

This patent is subject to a terminal disclaimer.

(21) Appl. No.: 09/436,066

(22) Filed: Nov. 8, 1999

Related U.S. Application Data

(60) Provisional application No. 60/039,125, filed on Feb. 25, 1997.

(51) Int. Cl.[7] ..... G06F 19/00
(52) U.S. Cl. ..... 702/45; 702/12
(58) Field of Search ..... 702/45, 50, 55, 702/6.12; 73/152.9, 15.51, 152.52, 861.03; 166/250.01, 250.15, 66, 66.6

(56) References Cited

U.S. PATENT DOCUMENTS

| | | | | |
|---|---|---|---|---|
| 4,150,721 A | | 4/1979 | Norwood | 166/53 |
| 4,568,933 A | | 2/1986 | McCracken et al. | 340/855.3 |
| 4,633,954 A | | 1/1987 | Dixon et al. | 166/372 |
| 4,799,169 A | | 1/1989 | Mims | 702/47 |
| 4,916,617 A | | 4/1990 | Norwood | 702/13 |
| 4,989,671 A | | 2/1991 | Lamp | 166/53 |
| 5,132,904 A | | 7/1992 | Lamp | 700/282 |
| 5,172,717 A | | 12/1992 | Boyle et al. | 137/155 |
| 5,253,713 A | | 10/1993 | Gregg et al. | 166/372 |
| 5,597,042 A | | 1/1997 | Tubel et al. | 166/250.01 |
| 5,706,896 A | | 1/1998 | Tubel et al. | 166/313 |
| 5,785,123 A | | 7/1998 | Lea, Jr. | 166/365 |
| 5,803,167 A | | 9/1998 | Bussear et al. | 166/65.1 |
| 5,983,164 A | * | 11/1999 | Ocondi | 702/12 |

* cited by examiner

*Primary Examiner*—Kamini Shah
(74) *Attorney, Agent, or Firm*—Donald W. Magnolia

(57) ABSTRACT

In a coal seam gas well, variable speed submersible pumps are used to remove the water from the well bore in order to release the methane gas absorbed in the coal bed and in the water. To optimize gas production, the liquid must be removed at an optimum rate, while still maintaining a certain minimum fluid level within the bore. To achieve this optimum control of the pump, analytical data of liquid flow rate, liquid level trend within the bore, and operating data of the submersible pump is used to control the liquid pump speed and the on-off timing of the liquid pump. High-resolution trending and event-log data provide artificial intelligence control to improve recovery of liquids from a coal seam gas well reservoir, and to reduce the operating cost.

18 Claims, 3 Drawing Sheets

METHOD AND APPARATUS FOR MEASURING AND CONTROLLING THE FLOW OF FLUIDS FROM COAL SEAM GAS WELLS

RELATED U.S. APPLICATION DATA

This application claim the benefit of and is a continuation in part of United States Provisional Application Serial No. 60/039,125, filed Feb. 25, 1997, for IREC METHODOLOGY, and U.S. patent application Ser. No. filed Feb. 25, 1998, for Method and Apparatus for Measuring and Controlling the Flow of Natural Gas from Gas Wells, now U.S. Pat. No. 5,983,164 issued Nov. 9, 1999.

BACKGROUND OF THE INVENTION

1. Field of the Invention

The present invention relates to systems and methods for measuring volume and rate of fluid extraction from coal-seam gas wells, and the trending of volume and rate of fluid extraction from coal-seam gas wells by electrical means using differential pressure and metering with time integration. More specifically it relates to a methodology for automatically controlling variable speed submersible pumps in a coal-seam gas well to optimize both the water removal process and gas production from the wells. In addition, it relates to methods of remote trending data acquisition and remote event logging of fluid level, submersible pump speed, and submersible pump torque in a coal-seam gas well, and using the data to control and optimize production from the coal-seam gas well from a remote location.

2. Description of the Related Art

Coal-seam gas wells produce both hydrocarbon gases, primarily methane, and liquids, primarily water, herein referred to in combination as "fluids." Referring to fry previous invention and claims, as set forth in U.S. Pat. No. 5,983,164, the method and apparatus for measuring and controlling the flow of natural gas from gas wells is taught. However, it neither teaches nor suggests the use of V-cone meters in such systems. In the past, the V-cone meter has been thought to be more suitable for measuring low volume gas of the type found in most coal-seam gas wells.

A typical coal-seam gas well has a low volume of gas production, for example less than 200 MCFD thousand cubic feet of methane gas and 200 Barrels of water per day per gas well. Gas is produced when water is removed from the coal-seam gas well bore. Therefore, removing or pumping out the water from the coal-seam gas well is the key aspect for the production of gas. In deep coal-seam gas wells, say below 7,000 feet, conventional beam-pumps are used to remove water from the coal-seam gas well. In less deep wells, submersible pumps are more practical and economical to use to remove water from the coal-seam gas well.

Coal-seam gas well liquid volume measurement devices are normally comprised of pulse train signal generating components, such as turbine meters with magnetic pick up, or positive displacement systems with a reed switch. The frequencies generated by such liquid volume measurement devices are generally believed to be linearly proportional to the liquid flow rate and volume passing through the meter. Electronic systems are common features of such state of the art liquid measurement system Such electronic systems are capable of counting the frequency generated by such meters, and may include firmware to accumulate or to total the number of pulses, and also to display the current flow rate and/or volume in a specific time interval, say daily, weekly, monthly, lifetime and so on. The electronic systems are also capable of scaling and processing the accumulated pulse data into volume units such as barrels or gallons. It should be further noted that the water produced from a coal-seam bed gas well, after being charcoal filtered or otherwise processed naturally, is suitable for human consumption or for agricultural uses, and is therefore, a valuable marketable product.

However, the state of the art liquid measurement systems only accumulate or provide total liquid volume measurements for a particular flow period, which data is then extrapolated into hourly, daily, weekly or monthly volume. The trending profile of the amount of actual liquid pumped in a given time period is not currently available, nor do the state of the art liquid measurement systems provide either auditable data or analytical trending data for the liquid which is produced While analytical quality data or characterization in the above measurement systers is not an issue for accounting purposes, analytical quality data and characterization are vital information for control and optimization of a submersible pump used to remove liquid from a coal-seam gas well. In addition, as the water produced from a coal-seam gas well is a marketable product, analytical quality data and characterization can also be used to provides both records and an audit-trail for water custody transfer measurement. The state of the art systems are also capable of remote data acquisition of the accumulated daily, weekly or monthly volume of the water pumped. Instantaneous flow rate information is also available. This is similar to the prior art data acquisition capabilities for gas from gas well measurement systems, in which the state-of-the-art systems provide accounting data only.

In most coal-seam gas wells, submersible pumps with variable speed controllers are used as liquid removal systems. Removal of the liquid from a coal-seam gas well is required for release and recovery of the hydrocarbon gases, such as methane, absorbed in the liquid. However, removing liquid from a coal-seam gas well also lowers the hydrostatic head pressure of the liquid in the well. The state of the art systems do not provide analytical quality data for use in effectively controlling and producing gas and liquid from a coal seam well. With out interface software and systems to communicate with the variable speed controller of the pump, the-state-of-the-art system is incapable of fully automated operation for producing gas and liquid from a coal seam well. Therefore, manual operation and routine site visitation are a current state of the art necessity, and a costly part of a gas and liquid coal seam well operation. In the current state of heart strategic control of the pump run-time, the pump speeds, and the discharged pressure, has not been used to optimize the amount of gas and liquid produced from a coal-seam gas well, or to extend the life of the pump.

It would therefore be desirable to provide a method and system which provides analytical trending data of the liquid production and liquid level trending profile from a coal seam gas well. It would also be desirable to provide such a method and system which provides analytical trending data of the gas from a coal seam gas well. It would be further desirable to provide such a method and system that provides analytical trending data of both the gas and the liquids, i.e. the fluids from a coal seam gas well.

SUMMARY OF THE INVENTION

It is therefore an object of the present invention to provide a method and system which provides analytical trending data of the liquid production and liquid level trending profile of a coal seam gas well.

It is a further object of the present invention to provide such a method and system which also provides analytical trending data of gas from a coal seam gas well.

It is yet an additional object of the present invention to provide such a method and system that provides analytical trending data of both the gas and the liquid, i.e. the fluids, from a coal seam gas well.

Strategic control of submersible pump run-time, pump speeds, and the discharged pressure, will optimize the amount of gas and liquid produced from a coal seam gas well, and extends the life of the pump. To maintain and optimize gas production from a coal-seam gas well, the well must not be pumped dry or the liquid pump turned off when liquid is present in the well bore. Therefore, trending of the fluid level by means of reading the pressures at the bottom of the well and at the surface is critical information to control the pump. However, the pump must be shut-off if the liquid level falls-below a pre-set level and turned on when certain fluid level is allowed to build up. Therefore, the trending characterizations of the liquid and gas flow-rates as well as the fluctuation of the liquid levels with respect to time provide valuable diagnostic as well as auditable measurement data to optimize and control the operation of a coal seam well. The trending methodology creates high resolution trending profiles for liquid flow rates and liquid levels that represent the operating conditions of the submersible pump used as a prime liquid removal system for coal-seam gas wells. In the present invention, fuzzy logic or artificial intelligence control software based on characterization of liquid flow rates and liquid level profiles results in optimization of the gas produced. In addition, the methodology of the present invention enhances the resolution of the trending data and proper handling of power outages to the pump by time stamping all analog and digital events data.

To enhance the accuracy and quality of the trending data of liquid from a coal seam gas well, an improved method of data trending with a configurable variable-time-base is provided. Fuzzy logic or artificial intelligence control software is provided to effectively control the variable speed pump to enhance both liquid and gas production from the coal-seam gas well. The determination of remote trending of the liquid flow-rates provides a database for auditing and resolving custody-transfer measurement disputes of liquid removed from a coal seam gas well.

As noted above, common liquid measurement devices; turbine or positive displacement meters, generate pulse signals whose frequency is directly proportional to the velocity of the liquid flowing through the meter. The inclusion of trending the pulse train employs a simple logic of timing and counting the pulses for preset time intervals that can be downloaded as electrical signals to either an adjacent or a remote component. Each data point is time stamped before being storing in a circular buffer in the adjacent or remote component so that the trending data can be seamlessly retrieved and stored with unlimited time by the host component. The host component, which includes a data system, such as a simple desk top PC and, for example a portable note-book system, running state of the art software, such as Windows 95 or better, will display the trending data on a monitor, along with the event-log to effectively operate and optimize the production of gas and liquid fluids in an automated mode.

The existing trending system, as described in U.S. Pat. No. 5,983,164 is now improved to include a fixed time interval of digitally averaged data and data compression is employed during data transmission between the host and the remote components. To enhance and control the resolution of the data trend, the time interval of the averaged data point is configurable and downloadable from the host component system.

The Fuzzy logic or artificial intelligence control software of the present invention achieves optimum liquid production or removal process using a variable speed submergible pump. The key factor that affects the gas de-sorption process or release of the gas from the coal bed and liquid is to maintain an optimum flow of the liquid at a minimum fluid level. Test results have shown that most coal-seam gas wells there appears to be a co-relationship between the liquid removal rate and the optimum gas production. Therefore, the control software is designed to control the pump speed based on historical trends of liquid flow rate, gas flow differential pressure, pump torque, pump speed, liquid level, and line pressure within each well.

In order to allow remote control of submergible pumps within coal-seam gas wells, a vital liquid removal system, interface software and hardware are in operative communication with the pump controller via a newly developed serial data port. The software enables the remote component to monitor and log the operating status of the pump and trend the operating parameters such as pump speed, running torque, and operating current. Menus which are taught and detailed below allow an operator to remotely download control strategy changes, such as pump speed changes, torque limit and fluid level zones to shut down pump, and time delay with fluid level build-up to restart pump. By leaming the operating trend of the pump and the production characteristic of the coal-seam gas well artificial intelligence to properly control the pump may be developed. The present invention, in conjunction with the gas measurement and control taught by U.S. Pat. No. 5,983,164 allow complete automation of the gas and liquid production from a coal-seam gas well.

The availability of pump trending or diagnostic data, and the ability for an adjacent or remote component to communicate with thee submersible pump controller allows operation of the coal-seams gas field from the office or where a conventional or cell phone service is available. Significant savings of manpower and vehicle cost are realized by operating in a fully automated mode.

These and other objects of the present invention will become apparent to those skilled in the art from the following detailed description and accompanying drawings, shown the contemplated novel construction, combination, and elements as herein described, and more particularly defined by the appended claims, it being understood that changes in the precise embodiments to the herein disclosed invention are meant to be included as coming within the scope of the claims, except insofar as they may be precluded by the prior art.

BRIEF DESCRIPTION OF THE DRAWINGS

The accompanying drawings which are incorporated in and form a part of this specification illustrate complete preferred embodiments of the present invention according to the best modes presently devised for the practical application of the principles thereof and in which.

DETAILED DESCRIPTION OF THE INVENTION

Figure 1:
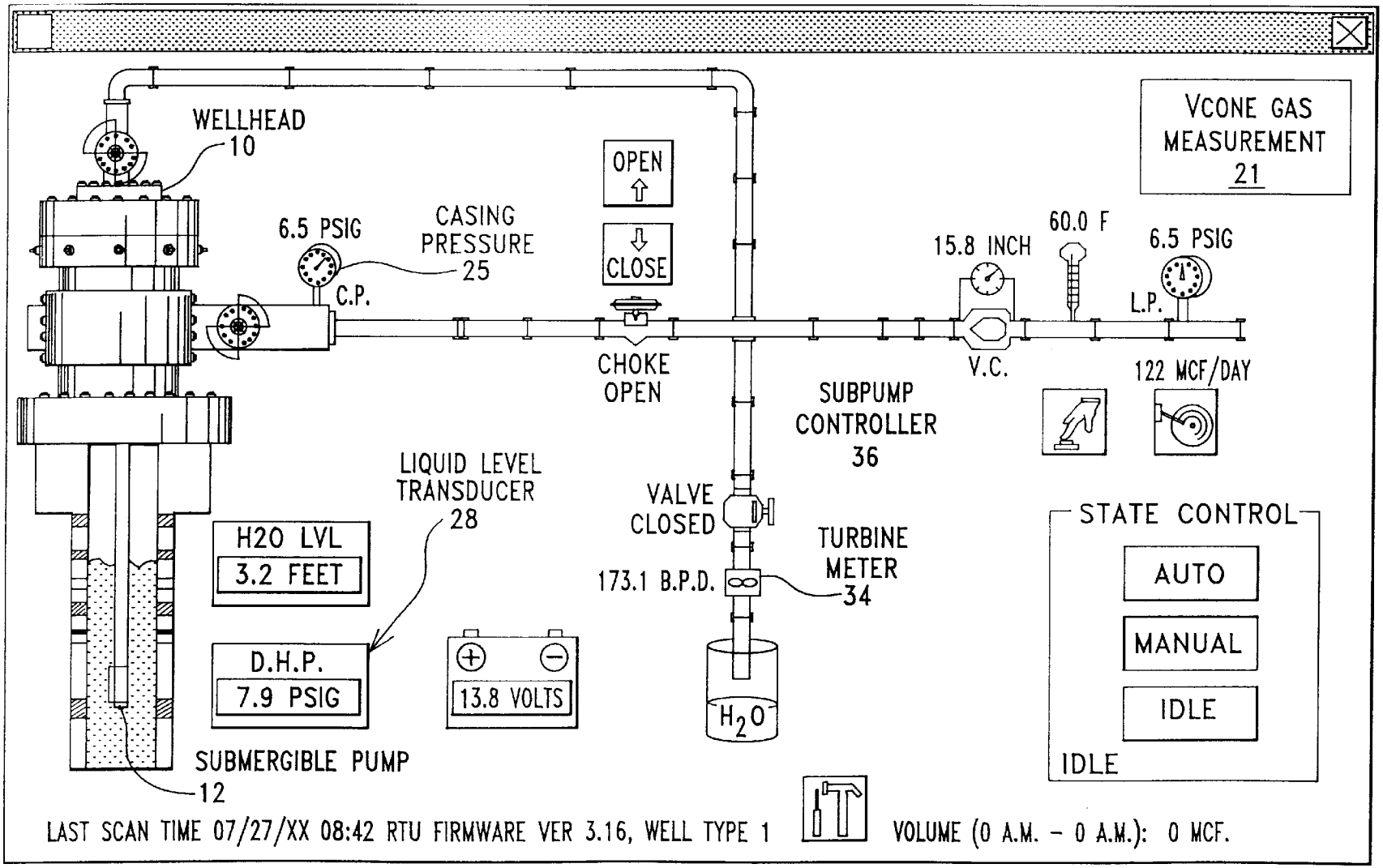
FIG. 1 is a schematic representation of the coal-seam gas well incorporating transducer elements and the pump controller in operative communication with the remote component system.

For the purposes of promoting an understanding of the principles of the present invention, reference will now be made to the embodiments and alternatives illustrated in the drawings and specific language will be used to describe the same. It will nevertheless be understood that no limitation of the scope of the present invention is thereby intended. The embodiments illustrated and explained are exemplary only. Like reference numerals are used to designate similar structures in the views of the various figures. Alterations and modifications of the illustrated apparatus and methods, and such further applications of the principles of the present invention as illustrated therein being contemplated as would normally occur to one skilled in the art to which the present invention relates are intended to be within the scope of the present invention.

Referring first to FIG. 1, a schematic representation of gas well head, generally 10, incorporating various transducer elements, variable speed submersible pump controller, and liquid turbine meter of the remote component system. Various pressure and temperature data is shown for representative purposes only. When the coal-seam gas well is completed, a variable speed submersible pump 12, along with a liquid level transducer 30, attached to the end of a tubing are lowered to the bottom of the well-bore. Liquid (water) migrated in to the well bore will be pumped out of the formation and measured by turbine meter 34. The liquid is currently discharged to a near by creek. To measure the liquid level, a small sealed pipe is lower to the well bottom and transducer 28 measures the bottom-hole pressure. The differential pressures between the bottom-hole pressure and the surface pressure derive fluid level. The gas volume will be flowing through the annulus and out of the casing side and through the V-Cone meter system 20 to provide a differential pressure reading at transducer 22, in the manner, which is well known in the art. Downstream of the V-Cone 20 are standard temperature transducer 24 and standard static line transducer 26

To monitor and trend the operating conditions of the submersible pump; a MODBUS communication protocol was written in the remote component to communicate serially via Telemetry Driver 42 with the pump controller 36, installed next to the well head. The controller is a microprocessor-based system capable of full control of the variable speed pump 12. It also provides trending data of motor speed, operating torque, and frequency. To provide monitoring and control of the pump at the host, an operating menu per FIG. #4 was developed. The remote component will scan the controller to retrieve and store trending and to log event data The data from the remote 32 are transferred to the host system 40 during a routine, or demand scan to up date the trending and event log files. The menu will allow the operator to download control strategy changes. Control of the pump is based on adjusting the speeds with respect to the fluid level changes. The pump will be automatically shut off if the liquid reaches a preset level. Restarting the pump after shut-off can be automatically activated after fluid level reaches a preset level.

Pulse signal from turbine meter 34 is electrically connected to remote component system's digital sensors 34 where the number of pulse will be counted by data logging manager 36 and stored at memory manager 38. The time interval to store each data point, a series of which are formed to produce seamless trending profile, is configurable through the host component 40. Each data point stored will be time stamped. The trending data can be retrieved by the host component 40 and stored in mass storage 54.

Fluid level can be calculated by subtracting the downhole pressure 30 from the casing pressure 28. The fluid level and the liquid flow rate are sent to the pump controller via the serial port to achieve pump control by changing speed to maintain a preset fluid level. Trending profiles of liquid flow rate and liquid level data along with the pump torque results are used to determine the well pump-off condition that will lead to shutting off the pump to prevent damage to the pump due to lack of fluid to lubricate the pump. Pumping the well dry may limit or choke the gas production. The pump control softwares based on the analysis of the trending data of the pump operating condition, fluid level, and torque, constitute an invention.

Figure 2:
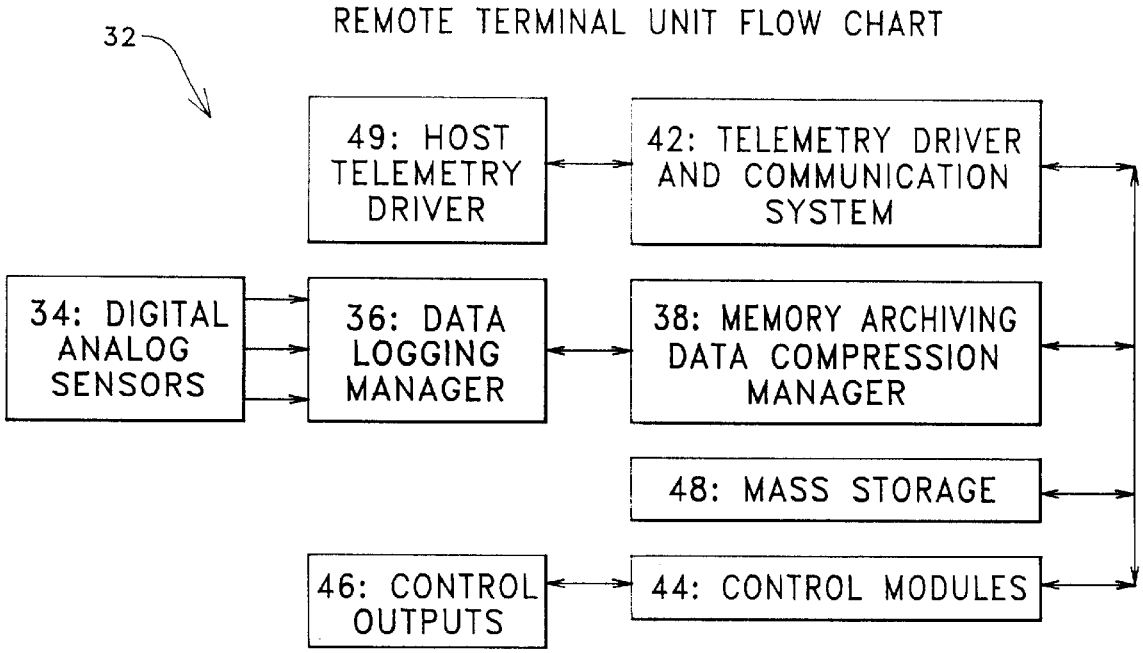
FIG. 2 is a simplified flow-charts of the remote component system of the present invention.
Figure 3:
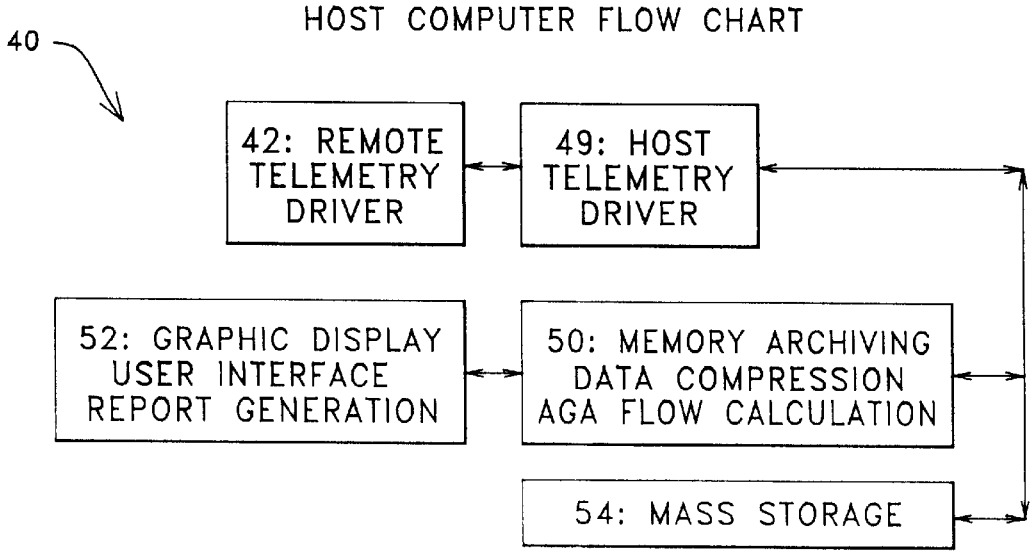
FIG. 3 is a simplified flow-chart of the host component system of the present invention.
Figure 4:
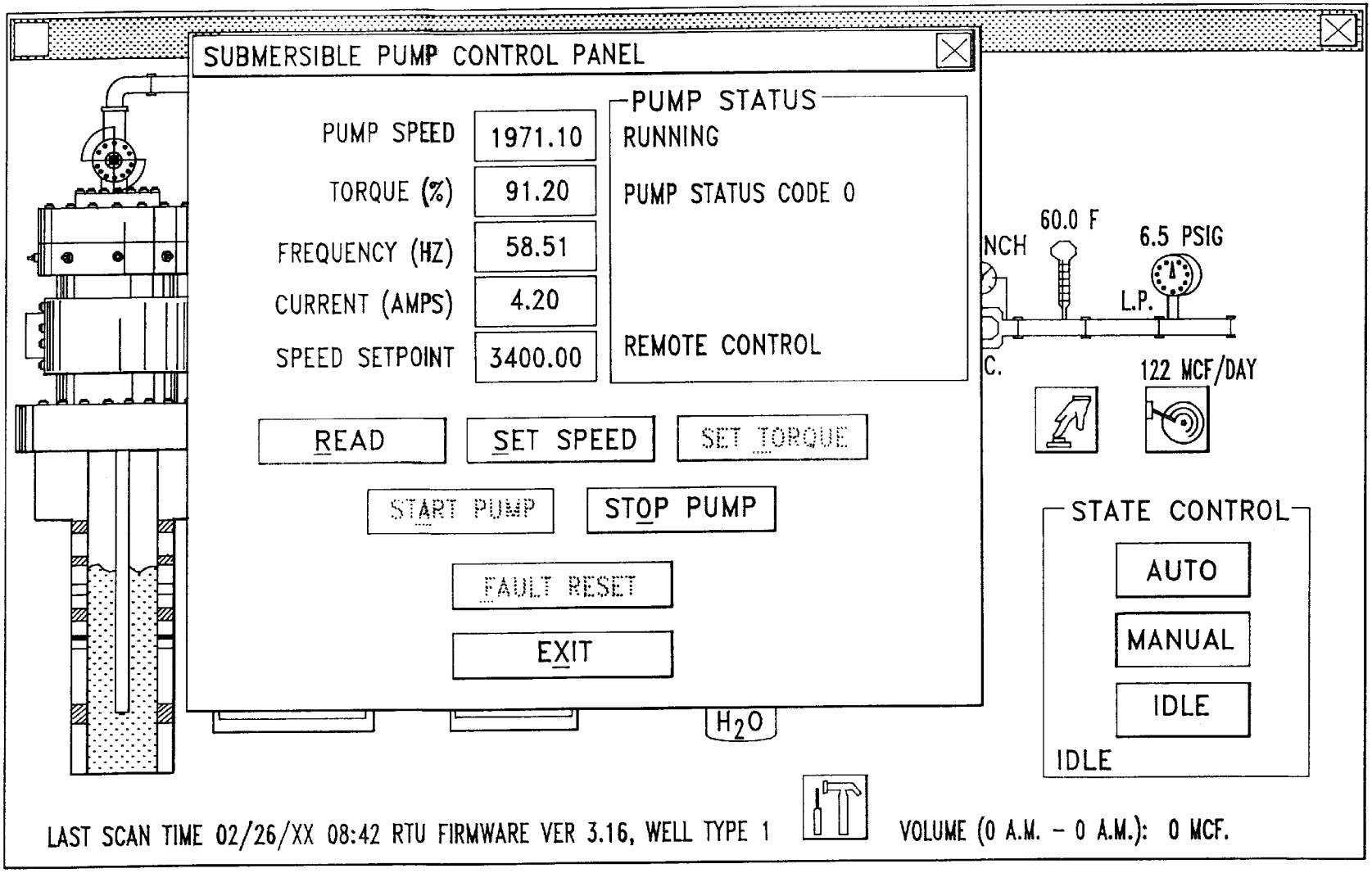
FIG. 4 is a remote operator interface system that allows the operator to monitor and control the submersible pump from the host component and the communication system, which is in operative communication with the remote component, and the variable speed controller.

Now referring to the simplified flow-chart of FIG. 2, the operation of the remote component system, generally 32; of the present invention will be explained. Analog and digital data is transmitted from transducers 22 (differential pressure reading), 24 (temperature transducer), 26 (static line transducer), 28 (casing pressure transducer), 30 (liquid level pressure transducer) and 34 (turbine meter pulse signal) are electrically connected to input device 34, and thence transmitted to data logging manager 36 for storage on any media, and for further transmission to memory archiving data compression and data management system 38. The compressed data is then transmitted to the host component system, generally 40, see FIG. 3. Transmission may be by remote telemetry system 42, as shown, or by direct wiring, which is normally not practical in view of the vast distance between the gas wells and the central operations office. Telemetry driver & communication system 42 is also capable of transceiving operation with another well's site remote component system or it can communicate with the pump controller. Remote telemetry system 42 may most efficiently operate by means of a wireless or conventional phone line system, although other state-of-the-art transmission means, such as satellite transmission, may be used.

In preferred embodiments the data management system 38 can be programmed to activate control modules 44 to be in operative communication with control outputs 46, which is an intelligence or programmable variable speed pump controller. Control Modules 44 is capable of direct communication by means of serial data transfer with a MOD-BUS communication protocol via telemetry driver and communication system 42. Control strategy of conditional speed changes to maintain a preset fluid level read by level transducer 30 is down loaded to the controller 36 to affect the control of the variable speed pump. Through the same method of communication, operating data such as pump status, operating torque, speed, are provided by the pump controller and are archived through memory archiving and data compression manager 38 of the remote component.

Referring again to flow-chart FIG. 2, the remote component system of the present invention will continue to scan and save all active analog data received from transducers 22, 24, 26, 28, and 30 at a preset interval. As explained above, the data will be compressed and stored both in short term memory archiving data compression and data management system 38, for say about a one month duration, and optionally, in preferred embodiments, in a mass storage system 48, using state-of-the-art storage devices may be used to store data from the remote component system for the life of the well. One such preferred mass storage device is a PCMCIA card with up to 100-MB capacity or about 50 years of data storage. Event logs of digital status changes or software status changes will be time stamped and stored in Event log files. Referring now to flow-chart FIG. 3, the host component system of the present invention includes a telemetry driver 48 for receiving data from and sending data to telemetry driver 42. this data is then processed through memory archiving data compression AGA-3 or V-Cone format flow calculation processor 50 from which it can be evaluated, for example in preferred embodiments by displaying it as a graphic display on graphic display user interface report generation monitor/input device 52. As explained above, the data will be stored both in short term memory in module 50, again for say about a one month duration, and optionally, in preferred embodiments, in a host mass storage system 54, again using state-of-the-art storage devices.

In preferred embodiments, the system of the present invention host component system 40 includes a computer, say a personal computer running, for example Windows software, say versions 3.1 and higher, capable of uploading data from the system of the present invention remote component system 32, as well as downloading control strategies back to the remote component system 32, again by means of a wireless or conventional phone line system, for example. Specifically designed computer software, a sample of which is submitted with this application, allows the host component system to splice the trending data seamlessly for the life of the well. The latest versions of AGA-3 and AGA-8 or V-Cone formula may be loaded along with software to handle flow calculation to determine gas flow volume. By the same calculation and integration process, liquid volume and liquid level can be computed and translated in to engineering units. This provides an effective way to recalculate the gas as well as liquid volume for any time period using modified parameters or scaling factors, thereby providing a means which can be used to settle volume disputes between producers and pipeline operators. The system of the present invention host component system is essentially an electronic chart integrator with no retracing or human intervention required, thereby having high reproducibility, and no opportunity for human error. The raw database is maintained as a permanent record or audit-trail of the well.

Using the V-cone in place of the orifice meter has the advantages of reduced pressure drop across the meter by almost 30% while extending the measurable ranges more than three times the orifice meter. This is critical for coal-seam gas well with low volume and low pressure.

Accordingly, the objects and advantages of the above inventions are described in my previous U.S. Pat. No. 5,983,164 for Method and Apparatus for Measuring and Controlling the Flow of Natural Gas from Gas Wells.

The inventions in which exclusive rights are claimed are:

1. Methods for measuring the volume and rate of a coal seam gas well flow from a coal seam gas well head by electrical means to eliminate gas volume measurement errors associated with intermittent or erratic gas flow conditions in a system using a liquid meter in operative communication with the coal seam gas well site, a differential pressure transducer, a temperature transducer, and a static pressure line transducer associated with the gas well head, including the steps of:

providing a first electric component system having an input portion and in operative communication with a gas well site, said component system having calibration data, gas flow parameters, and control configurations.

transmitting analog electric data signals as a function of time from at least the differential pressure transducer, the temperature transducer, and the static pressure line transducer to said input portion of said first electric component system;

transmitting digital electric event data signals as a function of time to an input portion of said first electric component system;

transmitting electrical digital pulse signals generated by said liquid meter to said first component system;

transmitting analog electrical signals of torque, speed, and digital events of the pump operating status generated by said liquid meter to said first component system and to a data logging manager for storage;

transmitting said digital electric event data and pulse signals to a data logging manager for storage; and then presenting said analog electric data to said data logging manager and said digital electric event data from said signals for display and analysis of well characteristics and events from said signals, including volume and rate of gas well flow and liquid flow from a coal seam gas well head to which it is in operative communication.

2. The methods of claim 1 wherein said analog electric data and said digital electric event data from said signals are retrievably stored for subsequent use in determining gas and liquid volume flow and analyzing data trending.

3. The methods of claim 2 wherein said stored digital electric event data is used to measure the actual gas flow period of said coal seam gas well for any substantially current or previous time for integration of actual gas and liquid flow at that time.

4. The methods of claim 2 wherein said stored analog electric data and digital electric event data are used for coal seam gas well control.

5. The methods of claim 2 wherein said stored analog electric data and digital electric event data are used to provide trending data and event logging for use in accurate gas and liquid volume flow measurement for any substantially current or previous time.

6. The methods of claim 2 wherein said stored analog electric data and digital electric event data are retrievable for subsequent use in accurately determining or analyzing data trending and gas and liquid volume flow for any substantially current or previous time.

7. The methods of claim 2 wherein said stored analog electric data and digital electric event data over a period of time are spliced to form a seamless trending database.

8. The methods of claim 1 wherein a casing pressure transducer and a tubing pressure transducer in operative communication with a coal seam gas well site are also placed in analog electric signal connection with said first component system.

9. The methods of claim 2 wherein said analog electric data and said digital electric event data are retrievably stored for subsequent use in a memory archiving data management system for use in accurately determining or analyzing data trending and gas and liquid volume flow.

10. The methods of claim 1 wherein a second electric component system with calibration data, gas flow parameters, and control configurations is installed at a distance from the gas well site, and wherein said analog electric data and said digital electric event data are transmitted to said second electric component system for analysis of coal seam gas well characteristics and events from said signals, including volume and rate of gas and liquid well flow from a coal seam gas gas well head.

11. The methods of claim 10 wherein said stored analog electric data and digital electric event data are used for coal seam gas well control.

12. The methods of claim 11 wherein said analog electric data and said digital electric event data are transmitted to said second electric component system using data compression techniques.

13. The methods of claim 12 wherein said presentation of said analog electric data and said digital electric event data for analysis of coal seam gas well characteristics and events is by means of a visible display.

14. The methods of claim 12 wherein said visible display is on a monitor screen.

15. The methods of claim 13 wherein said presentation of said analog electric data and said digital electric event data for analysis of well characteristics and events is by means of a visible display.

16. The methods of claim 1 wherein said system includes means for automatically calibrating some or all of the transducers as a function of the temperature in the portion of the coal seam gas wellhead where the transducers are located.

17. The methods of claim 1 wherein liquid level transducer data is placed in analog electric signal connection with said first component system.

18. The methods of claim 2 wherein said stored analog, digital event, and turbine meter data are used to control the submersible pump.

* * * * *